US007333624B2

(12) United States Patent
Husung

(10) Patent No.: US 7,333,624 B2
(45) Date of Patent: Feb. 19, 2008

(54) HEARING AID DEVICE AND OPERATING METHOD FOR AUTOMATICALLY SWITCHING VOLTAGE SUPPLY TO A CONNECTED EXTERNAL DEVICE

(75) Inventor: Kunibert Husung, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 611 days.

(21) Appl. No.: 10/950,016

(22) Filed: Sep. 24, 2004

(65) Prior Publication Data

US 2005/0111679 A1 May 26, 2005

(30) Foreign Application Priority Data

Sep. 24, 2003 (DE) ..... 103 44 366

(51) Int. Cl.
*H04R 25/00* (2006.01)

(52) U.S. Cl. ..... 381/312; 381/323

(58) Field of Classification Search ..... 381/312–315, 381/322–324

See application file for complete search history.

(56) References Cited

U.S. PATENT DOCUMENTS

| | | | | |
|---|---|---|---|---|
| 5,131,046 | A | 7/1992 | Killion et al. | |
| 6,606,391 | B2 * | 8/2003 | Brennan et al. | 381/316 |
| 6,985,598 | B1 * | 1/2006 | Joschika | 381/323 |
| 2004/0008854 | A1 | 1/2004 | Sauer | |

FOREIGN PATENT DOCUMENTS

| | | |
|---|---|---|
| DE | 37 05 478 | 9/1988 |

* cited by examiner

*Primary Examiner*—Suhan Ni
(74) *Attorney, Agent, or Firm*—Schiff Hardin LLP

(57) ABSTRACT

In a hearing aid device and operating method with automatic switching of the hearing aid voltage supply for an external component connected to an audio input of he hearing aid via a single audio voltage supply contact. A load detection device measures the electrical load at the audio input and switches either the unregulated voltage of the hearing aid battery or the regulated voltage of a voltage regulator in a preamplifier of the hearing aid to the audio input dependent on the measured load.

10 Claims, 1 Drawing Sheet

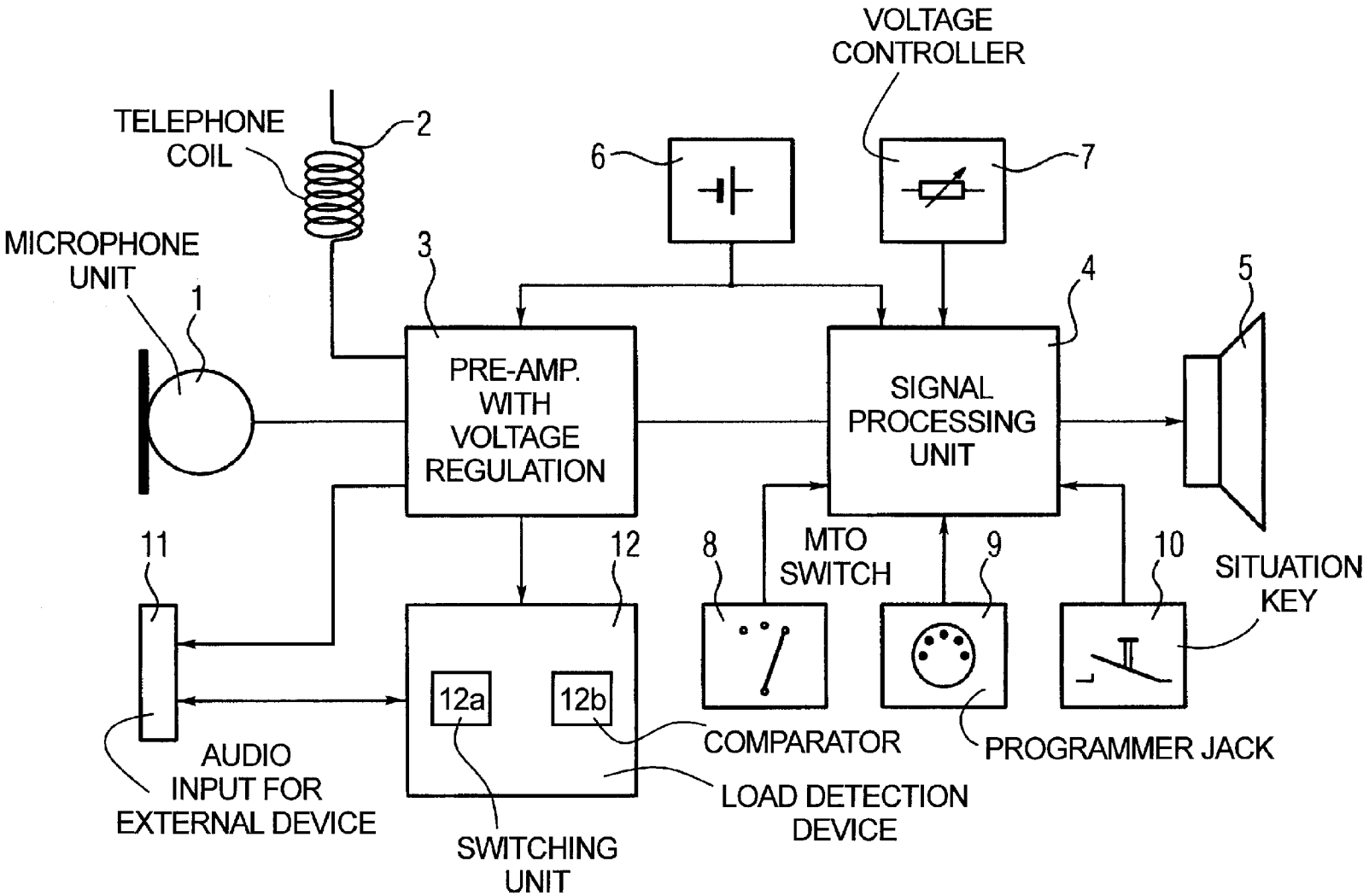
VOLTAGE CONTROLLER
7
6
2
TELEPHONE COIL
1
MICROPHONE UNIT
3
PRE-AMP. WITH VOLTAGE REGULATION
4
SIGNAL PROCESSING UNIT
5
MTO SWITCH
8
9
PROGRAMMER JACK
10
SITUATION KEY
12
12a
12b
COMPARATOR
LOAD DETECTION DEVICE
SWITCHING UNIT
11
AUDIO INPUT FOR EXTERNAL DEVICE

HEARING AID DEVICE AND OPERATING METHOD FOR AUTOMATICALLY SWITCHING VOLTAGE SUPPLY TO A CONNECTED EXTERNAL DEVICE

BACKGROUND OF THE INVENTION

1. Field of the Invention

The present invention concerns a hearing aid device of the type having a voltage supply that can be used to supply an external device that can be connected to the hearing aid device. The present invention also concerns a method for operation of such as external device connected to the hearing aid device.

2. Description of the Prior Art

Hearing aid device that are worn behind the ear in many cases have in the most cases an audio input that serves for the connection of external signal sources thereto. External signal sources are, for example, CROS (contraradial routing of signals) microphones, audio devices, FM transmission systems, etc. Some of these connected devices require a supply voltage delivered from the hearing aid device. Of these, for example, the CROS microphones require an extremely stable supply voltage with a relatively low current consumption. Thus a current requirement of up to approximately 300 μA exists for three microphones. Such a regulated voltage supply in this current range can be ensured using typical voltage regulators.

Other external devices that can be connected to the hearing aid device, such as, for example, miniature FM receivers, require a significantly higher current consumption of, for example, 1 to 2 mA. Since a voltage regulator exhibits a high-ohmic source impedance, such that the voltage would drop significantly given such high currents, a conventional voltage regulator is not suitable as a voltage source for these devices. For this reason, the unregulated battery voltage is provided for such devices at the audio input of the hearing aid device.

Heretofore, hearing aid devices typically have been equipped with a regulated supply voltage at the audio input, since predominantly CROS microphones with lower current consumption were the devices to be supplied therefrom. As small miniature FM systems later came onto the market, the hearing aid devices had to be correspondingly retrofitted for use with these systems. Modern hearing aid devices therefore are already provided with an unregulated supply voltage at the audio input. If the need arises to supply a CROS microphone, special microphone devices with internal voltage stabilization are therefore necessary.

From German OS 37 05 478, an electronic hearing apparatus with four connections is known, of which a first connection is connected with a first signal source that is, for example, a radio apparatus, a recorder, a radio or a warning device. A second connection is connected with a microphone and the third is connected with a computer. The fourth connection and, if applicable, further connections are provided for the connection of further signal sources.

From German Translation 690 31 227, a hearing aid is known with a switching circuit to which external components such as an on-off switch and a contact point are connected. The contact point is connected via a switching circuit connection with a voltage source that supplies the circuits in the switching circuit with various regulated voltages.

From German OS 102 11 364, an apparatus is known for deactivation of signal-processing devices of a hearing device. This device has a monitoring logic for activation and deactivation of a hearing device signal source.

Some hearing aid devices provide both a regulated and an unregulated supply voltage at the audio input. A disadvantage in such devices is that an additional audio contact is necessary, such that the audio input typically exhibits the following four contacts: signal contact, ground contact and two voltage supply contacts. A further disadvantage when both supply voltages must be provided is that a separate audio shoe or adapter, which serves to provide either the regulated or the unregulated operating voltage for the connected device, must be provided for each application case.

SUMMARY OF THE INVENTION

An object of the present invention to more comfortably design the voltage supply for external devices that can be connected to hearing aid devices.

This object is inventively achieved by a hearing aid device with a voltage supply for supplying an external device that can be connected to the hearing aid device, a load detection device to detect the electrical load that the external device produces on the voltage supply, and a control device for controlling the voltage that can be delivered by the voltage supply device, dependent on the detected electrical load.

The above object is achieved in accordance with the invention by a method for operating an external device connected to a hearing aid device having a voltage supply connectable to the external device, including the steps of detecting the electrical load that the external device produces on the hearing aid device voltage supply, and controlling the electrical voltage supplied to the external device dependent on the detected electrical load.

By virtue of the automatic load detection, a suitable supply voltage is always provided at the audio input. Retrofitting of the hearing aid devices thus is not necessary. Elaborate CROS devices with integrated filter circuits are likewise no longer necessary. Moreover, customer inquiries about device compatibility problems are avoided with and the value of the product as well as the customer satisfaction increase.

The voltage supply apparatus preferably has a regulated voltage source and an unregulated voltage source. It is thereby possible, for example, to automatically provide external devices with low current consumption with regulated current and to provide external devices with high current consumption with unregulated current.

The automatic switching between the regulated and unregulated voltage sources preferably ensues dependent the detected load that the external device exhibits.

The load detection device can be formed by a current measurement circuit and a comparator to compare a measured current with a switching threshold. It is advantageous that not only a load but also the occurrence of a short can be detected by the current measurement.

The load detection device alternatively can be formed by a voltage monitoring circuit and a comparator to compare a detected voltage with a switching threshold. The voltage monitoring has the advantage that it can be realized relatively simply.

DESCRIPTION OF THE DRAWINGS

The single FIGURE is a block diagram of an inventive hearing aid device.

DESCRIPTION OF THE PREFERRED EMBODIMENTS

The subsequent exemplary embodiment described in detail represents a preferred embodiment of the present invention.

The inventive hearing aid device shown in the block diagram of the FIGURE has an microphone unit 1 (that may include one or more microphones) and a telephone coil 2 as input elements. Both components deliver a signal to a preamplifier 3 that is equipped with an A/D converter and a voltage regulator.

The preamplifier 3 feeds its output signal into a digital signal-processing unit 4 with a clocked end stage. The output signal of this digital signal-processing unit 4 is supplied to an earpiece or earphone 5.

Both the preamplifier 3 and the digital signal-processing unit 4 are supplied with current from a battery 6. Furthermore, a volume controller 7 that is connected with the digital signal-processing unit 4 serves for adjustment of the volume at the earpiece 5. The digital signal-processing unit 4 also can be switched to microphone operation, telephone coil operation or the off state via an MTO switch 8. The digital signal-processing unit 4 can also be programmed in a suitable manner with a programmer jack 9. Finally, the operational mode of the digital signal-processing unit 4 can be further specified by a situation key 10. It is thus possible, for example, to switch from pure telephone coil operation to a mixed operation with the inclusion of microphone signals. The microphone operation also can be specified by, with the situation key 10, selectively using one or more microphones for generation of the output signal.

The preamplifier 3 has an additional audio input 11 (which, as described below, also serves as an output for a voltage to the external devices) via which an audio signal from an external device such as, for example, a CROS microphone and/or a miniature FM receiver can be processed in the hearing aid device. The audio input 11 has on audio voltage supply contact that is connected to and fed by a load detection device 12. This load detection device 12 includes a voltage supply-switching unit with which either the voltage of the voltage regulator of the preamplifier 3 or the battery voltage of the battery 6, unregulated by the amplifier 3, can be switched to the audio input 11. For load detection, the load detection device 12 measures the current that flows from the supply voltage source 3 or 6 into the external device (not shown) connected to the audio input 11. In the event that the measured current is high, the battery voltage is selected by the switching unit 12*a* to supply the external device. Otherwise the voltage regulator of the preamplifier 3 serves as a voltage source.

The current measurement signal can be compared with a threshold by a comparator 12*b* integrated into the load detection device 12. In the event that the current measurement signal is above the threshold, this indicates a load with high current consumption. A current measurement signal below the threshold indicates a load with low current consumption.

In a further embodiment, the current measurement signal is additionally compared to a second threshold that is above the first threshold. This second threshold serves to be able to determine a short at the connected external device. By suitable selection of the second threshold, a consumer with high consumption and the occurrence of a short can thus be differentiated. In both embodiments, in an advantageous manner only one external voltage supply contact is necessary, although a voltage supply with two or more voltage sources is provided.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid device comprising, a hearing aid housing;

an audio connection at said hearing aid housing configured for connection to an external device exhibiting an external device load at said audio connector;

a voltage supply in said hearing aid housing; and a load detection and control device connected in said hearing aid housing between said voltage supply and said audio connector, for detecting said external device load at said audio connector and for automatically controlling a supply of voltage from said voltage supply to said audio connector dependent on the detected external device load.

2. A hearing aid device as claimed in claim 1 wherein said voltage supply comprises a regulated voltage source and unregulated voltage source.

3. A hearing aid device as claimed in claim 2 wherein said load detection and control device switches one of said regulated voltage source or said unregulated voltage source to said audio connector dependent on the detected external device load.

4. A hearing aid device as claimed in claim 3 wherein said load detection and control device comprises a current measurement circuit for measuring a current at said audio connector, and a comparator for comparing said measured current with a switching threshold for switching between said regulated voltage source and said unregulated voltage source.

5. A hearing aid device as claimed in claim 3 wherein said load detection and control device comprises a voltage monitoring circuit for measuring a current at said audio connector, and a comparator for comparing said monitored voltage with a switching threshold for switching between said regulated voltage source and said unregulated voltage source.

6. A method for operating a combination of a hearing aid device and an external device, comprising the steps of:

electrically connecting an external device to a hearing aid device;

supplying said external device with voltage from a voltage source in said hearing aid device;

detecting an electrical load that said external device produces on said voltage supply; and automatically electronically controlling supply of said voltage from said voltage supply to said external device dependent on the detected electrical load.

7. A method as claimed in claim 6 comprising supplying either regulated voltage or unregulated voltage from said voltage supply dependent on said detected electrical load.

8. A method as claimed in claim 7 wherein said voltage supply comprises a regulated voltage source and an unregulated voltage source, and comprising switching between said regulated voltage source and said unregulated voltage source dependent on the detected electrical load.

9. A method as claimed in claim 8 comprising detecting said electrical load by measuring current consumed by said external device and comparing the measured current to a switching threshold for switching between said unregulated voltage source and said regulated voltage source.

10. A method as claimed in claim 8 comprising detecting said electrical load by monitoring voltage consumed by said external device and comparing the monitored voltage to a switching threshold for switching between said unregulated voltage source and said regulated voltage source.

* * * * *